United States Patent [19]

Lu

[11] Patent Number: 4,537,327

[45] Date of Patent: Aug. 27, 1985

[54] TAPE CLOSURE FOR A CAN END

[75] Inventor: Shih-Lai Lu, Woodbury, Minn.

[73] Assignee: Minnesota Mining and Manufacturing Company, St. Paul, Minn.

[21] Appl. No.: 650,050

[22] Filed: Sep. 13, 1984

[51] Int. Cl.[3] ..... B65D 41/00

[52] U.S. Cl. ..... 220/359; 220/260

[58] Field of Search ..... 220/214, 260, 359, 270

[56] References Cited

U.S. PATENT DOCUMENTS

| | | | |
|---|---|---|---|
| 4,372,460 | 2/1983 | Brochman et al. | 220/359 |
| 4,378,074 | 3/1983 | Brochman | 220/260 |
| 4,397,401 | 8/1983 | Ueno et al. | 220/359 |
| 4,454,956 | 6/1984 | Patterson | 220/214 |

*Primary Examiner*—George T. Hall

*Attorney, Agent, or Firm*—Donald M. Sell; James A. Smith; Gerald F. Chernivec

[57] ABSTRACT

A container end assembly comprising a container end, typically metallic, with a pour opening therein; a coating over the container end comprising a carboxyl group-containing vinyl chloride/vinyl acetate copolymer composition, and a pressure-sensitive adhesive tape bonded to the coating which forms a bond thereto which is greater than that between the coating and the metallic container end, such that upon peeling of the tape from the container end, the coating delaminates in the area of the adhesive tape bond, and is removed with the tape, thus effectively masking the tape adhesive for tamper indication.

7 Claims, 4 Drawing Figures

TAPE CLOSURE FOR A CAN END

BACKGROUND ART

This invention relates to a container end assembly for use on beverage containers having a pour opening in the end covered by a length of removable tape. More particularly, the invention provides an improved tape closure for container ends permitting clean opening of the container with a tape closure, as well as tamper indication because the closure cannot be resealed once opened.

TECHNICAL FIELD

There are a number of tape closure assemblies utilized in conjunction with container ends, which are taught to be alternatives for scored aluminum can ends having a metal tab which must be lifted in accordance with the score lines in the aluminum end itself. One such tape closure mechanism has seen commercial utility in the area of liquids, such as fruit or vegetable juices. In such a tape closure system, a can end contains therein a preformed pour hole which is covered by a tape tab, attached to the can end by means of a pressure sensitive adhesive. The can may be opened by simply grasping the tape tab and lifting from the metal end surface, thereby exposing the pour hole. One problem with such an assembly is that this system does not provide any indication of tampering. The pressure sensitive adhesive is contained on the tab closure, and is not masked by any other material. Thus, the tape closure can be resealed after opening, thereby providing virtually no tamper detection.

In another tape closure system, the can end having a pre-formed opening contains thereon dual coatings, the first coating being an enamel, such as an epoxy, and the overlayer thereon being comprised of a polymeric composition such as a vinyl chloride/vinyl acetate copolymer. A tape tab is positioned thereover and attached by a thermoplastic adhesive which is in essence heat bonded to the can end. Upon removal of the tape tab by lifting same upward, the vinyl chloride/vinyl acetate or outer polymeric coating is removed from the underlying enamel coating, thus providing a degree of tamper detection. Such a system is taught to be utilized for carbonated beverage-containing cans.

However, I am unaware of any current commercial system in use today wherein a can end having a preformed pour opening, utilizing a pressure sensitive adhesive-containing tape tab closure, can provide tamper detection.

SUMMARY OF THE INVENTION

In accordance with the invention, there is provided a container end assembly which comprises: (a) a container end, typically formed of a metallic material, which has an exterior surface and an interior surface and is formed with a pour opening therein; (b) a coating over at least the exterior surface of the can end, which is comprised of a carboxyl group-containing vinyl chloride/vinyl acetate copolymer composition; and (c) a pressure sensitive tape which is bonded to an area of the exterior surface of the coating which is circumjacent and covers the pour opening, the tape forming a bond to the coating which is greater than the bond between the coating and the metallic material forming the container end, such that upon peeling of the tape from the container end the coating delaminates in the area of the pressure sensitive adhesive tape bond.

In this manner, when the container having the end assembly discussed above is opened, the pressure sensitive adhesive on the tape is essentially masked by the coating which is removed therewith, thus providing an excellent indication of tampering, because the tape closure cannot be resealed as with prior art pressure sensitive tape closure systems.

DESCRIPTION OF THE DRAWING

With reference to the appended drawing.

Figure 1:
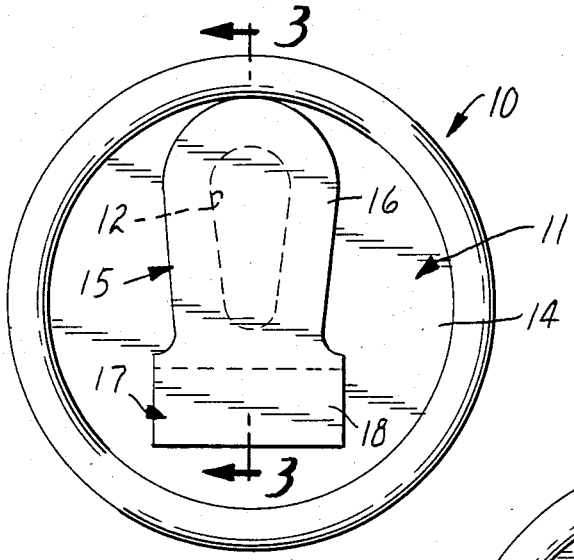
FIG. 1 is a top view of a can end assembly.

The drawing should be considered to be illustrative or exemplary only, as other can end assembly designs can utilize my invention.

DESCRIPTION OF THE PREFERRED EMBODIMENTS

More specifically, FIG. 1 illustrates can end assembly 10 comprising the metallic can end 11 having a preformed pour hole 12 therein, illustrated by dotted lines under tape closure 15. Tape closure 15 comprises tape 16 adhesively secured to can end 11 over pour hole 12, and grasping member 17 for use as a manual gripping area for removal of tape closure 15 from can end 11.

Figure 3:
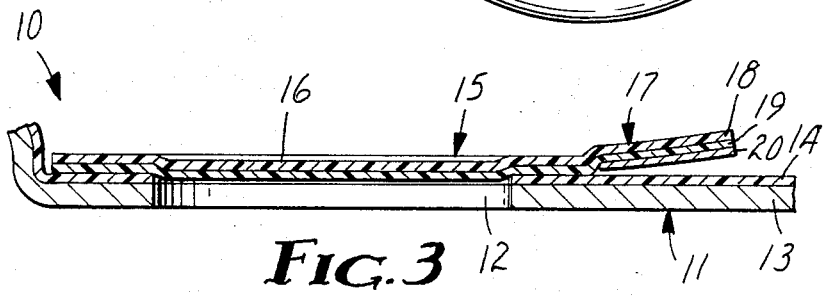
FIG. 3 is an enlarged sectional view of the can end assembly of FIG. 1, taken along 3—3 thereof.

FIG. 3 illustrates can end 11 of assembly 10 which comprises metal 13 having the coating of my invention 14 on the outward surface thereof. Tape closure 15 comprises tape backing 18 and pressure sensitive adhesive 19, with masking layer 20 covering or masking adhesive 19 at grasping member 17, thereby preventing adhesive bonding of member 17. Tape 16 is adhesively bonded to can end 11 at least at areas surrounding pour hole 12 to thereby effectively seal can end 11.

Figure 2:
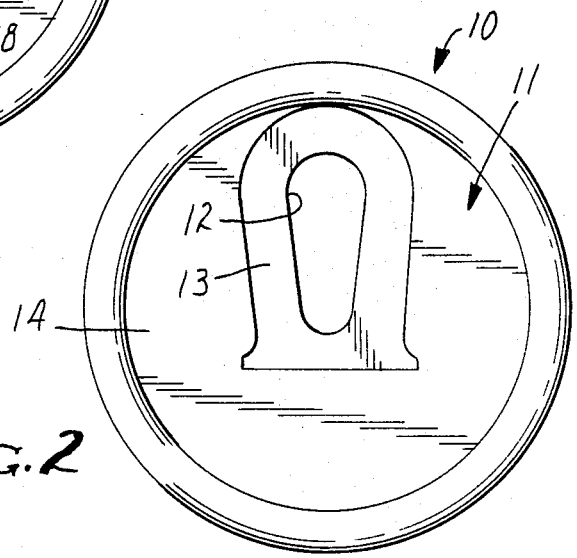
FIG. 2 is a top view of the can end assembly of FIG. 1 after removal of the tape closure.
Figure 4:
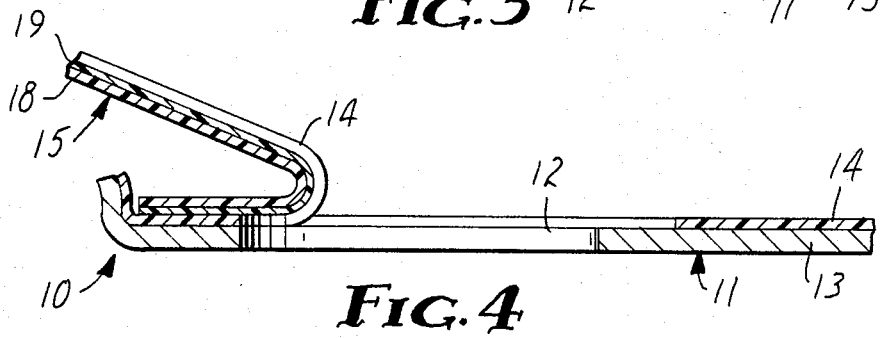
FIG. 4 is a similar sectional view with the tape closure partially removed from the can end.

FIG. 4 illustrates the partial removal of tape closure 15 from can end 11 wherein coating 13, which had been adhesively bonded to tape 16 by pressure sensitive adhesive 19 is removed from metallic layer 13 as tape closure 15 is lifted from can end 11. FIG. 2 illustrates can end assembly 10 after complete removal of tape closure 15. The portion of coating 14 under adhesive layer 19 and bonded thereby to tape 16 has been removed with tape 16, while remaining in areas not covered by and adhered to tape 16.

Thus, adhesive 19 has been masked or rendered non-adhesive over the entire surface of tape 16, and tape closure 15 cannot be readhered to can end 11.

Can end 11, in addition to my coating 14, can comprise bare metal, such as tin-free steel, tin-plated steel or black-plated steel. Such bare metal surfaces should be free of adhesion-inhibiting materials such as oil, etc., before application of coating 14 thereto. In addition, an enamel coating (not illustrated), such as an epoxy, can be applied onto the bare metal prior to application of coating 14 thereto.

My invention relates to the use of a carboxyl group-containing vinyl chloride/vinyl acetate composition for preparation of coating 14. This composition provides the necessary adhesion characteristics allowing for removal thereof by conventional pressure sensitive adhesives typically used in tape closure can end assemblies.

By the term "carboxyl group-containing vinyl chloride/vinyl acetate compositions" is meant that the vinyl copolymer itself can be modified by addition of carboxyl groups to the backbone thereof, or a carboxyl group-containing compound can be simply added to a solution of the vinyl copolymer to provide a simple mixture. In the latter case, the carboxyl compound must be compatible with the vinyl copolymer in the sense of allowing a homogeneous uniform mixture to be formed.

Examples of suitable carboxyl group-containing compounds include carboxylic acids such as acrylic acid, crotonic acid, etc.

In general, the adhesive and cohesive characteristics of the tamper-indicating tape closure system require that the adhesive force between pressure-sensitive adhesive 19 and coating 14 be greater than the adhesive (or cohesive) force between coating 14 and metal (or enamel) surface 13. Besides carboxyl functionality, molecular weight of the vinyl composition and the coating thickness of coating 14 are important parameters. For example, as the molecular weight of the composition increases, tensile strength thereof similarly increases, and thus coating thickness shall be reduced to maintain proper adhesion characteristics.

The invention will now be more specifically defined through the use of the following non-limiting examples, wherein all parts are by weight unless specified.

EXAMPLE 1

A solution was prepared by dissolving 5 parts of vinyl resin "VMCC", commercially available from Union Carbide, which is taught to be a copolymer containing 83 percent by weight vinyl chloride, 16 percent vinyl acetate, and 1 percent maleic anhydride, having a number average molecular weight of 15,000, in 95 parts of a solvent mixture containing isophorone/methyl ethyl ketone/toluene in a 1:5:15 weight ratio, respectively. A sheet of approximately 10 mil thick tin-free steel plate was dip coated with the solution to provide a coating thickness of about 0.05 mil after drying at 150° F. for 10 minutes. Similar results have been obtained utilizing a Mayer rod with 30 lines per inch. An 0.5 inch wide piece of "Scotchtab" Brand Closure Tape, a commercially available pressure sensitive adhesive tape used in providing tape closures from the Minnesota Mining and Manufacturing Company was adhered to the vinyl surface, after which the vinyl coating was effectively removed from the tin free steel plate by grasping the tape and lifting upwardly from the plate surface, thus providing distinct tamper indication by the inability of the "Scotchtab" tape to be readhered to the steel plate.

EXAMPLE 2

A conventional tin-plate can end, typically utilized for containing juice products therein, was coated with the solution of Example 1, again by dip coating. As in the previously example, the carboxyl group-containing vinyl coating was separated from the tin-plated metallic surface upon lifting of the "Scotchtab" tape therefrom.

EXAMPLE 3

A prepunched juice can end containing a coating of a conventional epoxy phenolic thereon (a typical enamel coating utilized with can ends containing product to be consumed) was dip coated with the solution of Example 1. The "Scotchtab" tape was then sealed to the can end around the pour hole area. The vinyl coating was again separable from the enamel surface upon removal of the tape tab by lifting therefrom.

What is claimed is:

1. A container end assembly comprising (a) a container end formed of metallic material having an exterior surface and an interior surface and being formed with a pour opening therein;

(b) a coating over at least the exterior surface of said container end, said coating comprising a carboxyl group-containing vinyl chloride/vinyl acetate copolymeric composition;

(c) a pressure sensitive tape bonded to an area of said exterior surface of said coating which is circumjacent and covers said pour opening, said pressure sensitive adhesive tape forming a bond to said coating which is greater than the bond between said coating and said container end, whereby upon peeling of said tape from said container end, said coating delaminates from said container end in the area of the pressure sensitive adhesive tape bond.

2. The can end assembly of claim 1 wherein said container end is selected from tin-free steel, tin-plated steel, and black-plated steel.

3. The container end assembly of claim 1 further having interposed between said coating and said metallic material an enamel coating.

4. The container end assembly of claim 3 wherein said enamel coating comprises an epoxy phenolic composition.

5. The container end assembly of claim 1 wherein said copolymer composition comprises a mixture of a vinyl chloride/vinyl acetate copolymer and an effective amount of a compound containing carboxyl groups therein.

6. The container end assembly of claim 1 wherein said copolymer composition comprises a vinyl chloride/vinyl acetate copolymer containing an effective amount of carboxyl groups attached to the backbone thereof.

7. The container end assembly of claim 6 wherein said carboxyl groups conprise about 1 percent by weight of said copolymer composition.

* * * * *